United States Patent [19]

Phillips et al.

[11] Patent Number: 4,498,308

[45] Date of Patent: Feb. 12, 1985

[54] NON-FLOODING REMOTE AIR COOLED CONDENSERS

[75] Inventors: Parker V. Phillips, Brontford; Ness Lakdawala, St. Lambert; Michel Lecompte, Mont St. Hilaire, all of Canada

[73] Assignee: Hussmann Store Equipment Limited, Brantford, Canada

[21] Appl. No.: 430,699

[22] Filed: Sep. 30, 1982

[51] Int. Cl.[3] ..... F25B 39/04

[52] U.S. Cl. ..... 62/184; 62/DIG. 17

[58] Field of Search ..... 62/184, DIG. 17, 181, 62/182, 183, 428, 429, 452, 453, 454, 455, 506, 507, 203; 98/119; 165/39

[56] References Cited

U.S. PATENT DOCUMENTS

| | | | |
|---|---|---|---|
| 2,697,587 | 12/1954 | Conison | 165/39 |
| 2,911,900 | 11/1959 | Rudy | 98/119 X |
| 3,004,402 | 10/1961 | Dart et al. | 62/184 |
| 3,112,620 | 12/1963 | Stewart | 62/DIG. 17 |
| 3,242,686 | 3/1966 | Bowman et al. | 62/184 |
| 3,390,538 | 7/1968 | Miller | 62/184 |
| 3,390,539 | 7/1968 | Miner | 62/DIG. 17 |
| 3,645,107 | 2/1972 | Quick | 62/507 |
| 4,193,781 | 3/1980 | Vogel et al. | 62/DIG. 17 |

FOREIGN PATENT DOCUMENTS

| | | | |
|---|---|---|---|
| 0102849 | 8/1980 | Japan | 62/203 |

*Primary Examiner*—Harry Tanner

*Attorney, Agent, or Firm*—Richard G. Heywood

[57] ABSTRACT

The invention relates to an outdoor air cooled condenser for use in a refrigeration system and a method of controlling the condensing temperature in the condenser. The condenser may be used for one or several closed refrigeration circuits connected thereto. A condenser coil assembly is provided in the condenser and has a condenser coil and a heat transfer surface, the coil being connected to the refrigeration circuit. A housing houses the condenser and has an inlet and an outlet for the passage of air through the housing about the heat transfer surface. The outlet is divided in a primary outlet and a plurality of secondary outlets. A motor-driven fan is provided with each of the outlets. The primary outlet is provided with a controllable damper while the secondary outlets are provided with gravity-operated dampers. A sensor is provided for each refrigeration circuit and is are connected to the condenser coil outlet to sense a predetermined refrigerant condition and feed a signal to a control circuit which analyzes the signal with respect to an ideal condition set point value for the refrigeration system. The control circuit controls the damper of the primary outlet and the operation of the fans to control the amount of air passing through the housing and the condenser coil heat transfer surface in response to changes in the refrigerant condition resulting from heat rejection load changes in the condenser coil or entering air temperature changes in the housing to substantially maintain the refrigeration system operating at the ideal condition set point value.

14 Claims, 3 Drawing Figures

INTEGRATOR
CONV.
DECODER
MOTOR CONTROL CKT
THER.
10
11
12
13
17
18
20
23
24
25
25A
26
27
28
29
30
31
32
33
34
35
36
37
38
39
40
41

FIG. 2
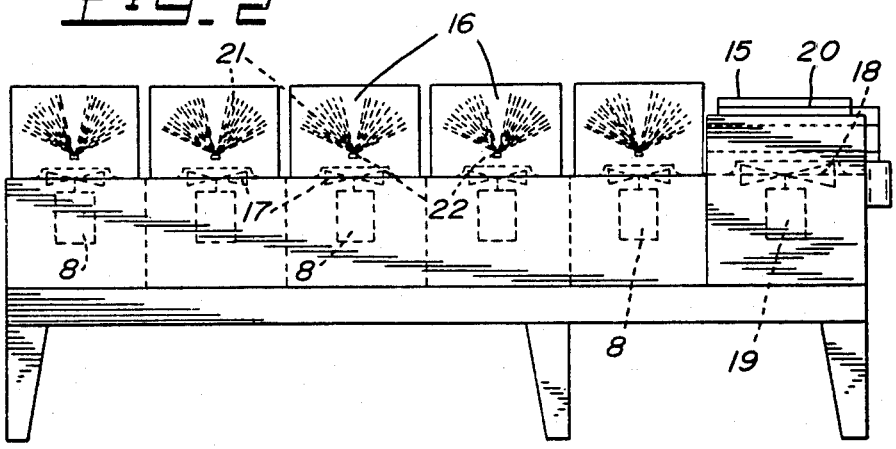
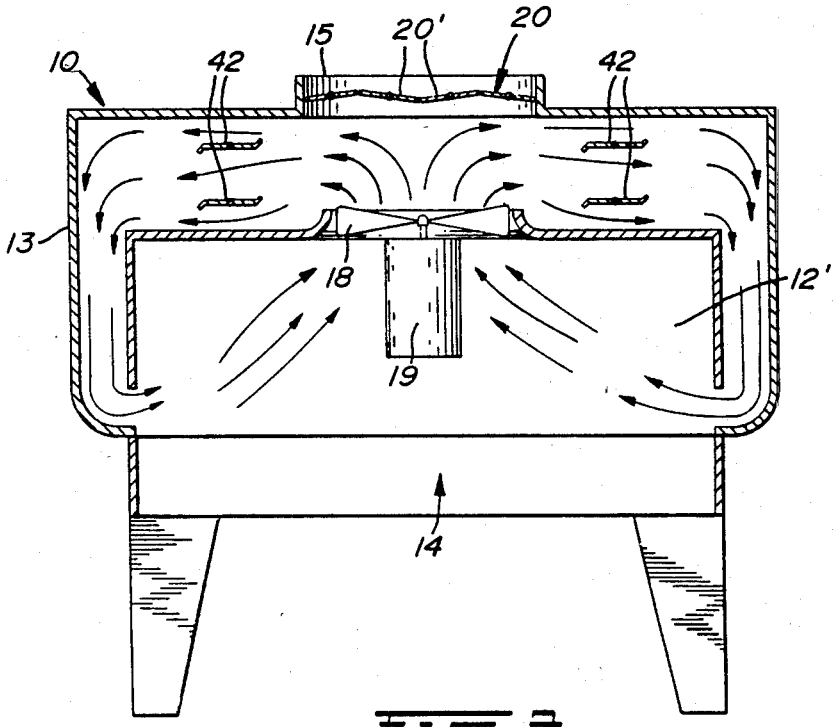
FIG. 3

NON-FLOODING REMOTE AIR COOLED CONDENSERS

BACKGROUND OF THE INVENTION (a) Field of Invention

The present invention relates to an improved outdoor air cooled condenser assembly for use in a refrigeration system having at least one refrigeration circuit, and preferably for use with a plurality of separate refrigeration systems operating at different temperature levels and further, wherein an ideal condition set point value for the refrigeration system is maintained by controlling the operation of a primary and a plurality of secondary air convection fans and damping means associated with the primary fan.

(b) Description of Prior Art

In prior art various methods have been devised to control condenser capacity, such as the provision of controllable dampers, fan speed controls, fan cycling, etc. But these have been found not totally satisfactory for a number of reasons, either they sense ambient air temperature and use this as a basis for control or they sense refrigerant conditions in a single circuit and use this as a basis for control. Sensing ambient air ignores heat rejection load changes as a load factor and sensing refrigerant conditions in a single refrigeration circuit assumes that all circuits should respond to the conditions in the circuit being sensed. This is not true. For example, if the circuit being sensed cycles off to control temperature, or goes into a defrost cycle, all other circuits will be subjected to conditions of no air through the heat transfer surface because the sensor detects no load, thus making the other circuits inoperative.

There is therefore a need to provide an improved outdoor air cooled condenser which could effectively control condensing temperature for a multicondenser coil circuit fed by a plurality of refrigeration circuits operating at different refrigerant temperature levels.

SUMMARY OF INVENTION

It is a feature of the present invention to provide an outdoor air cooled condenser which substantially overcomes the disadvantages of the prior art and which is capable of being used in a refrigeration system having a plurality of refrigeration circuits operating at different temperature levels.

It is another feature of the present invention to provide an outdoor air cooled condenser capable of controlling condensing temperature using remote outdoor air, during periods of extremely low entering air temperatures (−40° F.) and severe reductions in heat rejection loads, by control of air volume rather than by control of condenser surface area by flooding.

Another feature of the present invention is to provide an outdoor air cooled condenser capable of reducing refrigerant charge from a few pounds in very small systems to several hundred pounds in larger systems.

Another feature of the present invention is to provide an outdoor air cooled condenser which is energy efficient both at the power input to the condenser fans and in the power input to compressors of the refrigeration system.

Another feature of the present invention is to provide an outdoor air cooled condenser in which a reduction in refrigerant loss into atmosphere is reduced due to system refrigerant leaks.

Another feature of the present invention is to provide an outdoor air cooled condenser which results in reduced maintenance costs by eliminating winter flooding charges thus stabilizing the receiver refrigerant level. Also, the condenser eliminates backward wind-milling of the fans which contributes substantially to fan/motor bearing failure. Convection controlled dampers also keep the motors contained in a warm environment when idle thus preventing condensation to occur as a result of ambient temperature and humidity changes.

Another feature of the present invention is to provide a novel method of controlling condensing temperature in outdoor air cooled condensers which substantially overcomes the disadvantages of the prior art and which is usable with a multi-circuit refrigeration system with the refrigeration circuits operating at different levels.

Another feature of the present invention is to provide a novel method of controlling condensing temperature which is applicable as a retrofit to existing condensers due to its simplicity and ease of mechanical changes required to existing systems.

According to the above features, from a broad aspect, the present invention provides an outdoor air cooled condenser for use in a refrigeration system having at least one refrigeration circuit. The condenser includes a condenser coil assembly having a condenser coil and a heat transfer surface for the refrigeration circuit. A housing is provided to house the condenser coil and heat transfer surface and has an air inlet and outlet means for the passage of air through the housing about the heat transfer surface. The outlet means has a primary outlet and a plurality of secondary outlets. Air displacement means is associated with respect to each of the primary and secondary outlets. Convection control damper means is associated with each of the secondary outlets. Controllable damping means is associated with the primary outlet to control the size of opening thereof. Sensing means is connected to the condenser coil to sense a predetermined condition of the refrigerant therein. Control circuit means is provided for monitoring the sensor refrigerant condition with respect to a predetermined ideal condition set point value for the refrigeration system and controls the controllable damping means and the air displacement means of the secondary outlets to control the amount of air passing through the housing and the condenser coil heat transfer surface in response to changes in the refrigerant condition resulting from heat rejection load changes in said coil or entering air temperature changes in said housing to substantially maintain the refrigeration system operating at the ideal condition set point value.

According to a further broad aspect of the present invention there is provided a method of controlling condensing temperature in an outdoor air cooled condenser having at least one refrigeration circuit connected to a condenser coil assembly having a heat transfer surface and secured in a condenser housing. The housing has an inlet and outlet means with damper means and air displacement means for the convection of air from the inlet to the outlet means about the heat transfer surface. The method comprises the steps of sensing a predetermined refrigerant condition in the condenser coil and providing an error signal representative of the sensed condition. The error signal is analyzed with respect to a predetermined ideal condition set point value for the refrigeration system and a control signal is produced. The operation of air displacement means is varied when the error signal exceeds positive or negative tolerance levels from the set point value. The damper means is also controlled when the error signal is within the tolerance levels but above or below the set point whereby to substantially maintain the refrigeration system operating at the set point value.

BRIEF DESCRIPTION OF DRAWINGS

A preferred embodiment of the present invention will now be described with reference to the example thereof illustrated in the accompanying drawings in which:

FIG. 2 is a side view of the condenser showing the position of the primary and secondary air outlets and their associated fans and dampers; and FIG. 3 is a cross-section view of the primary air outlet and its associated fan and controlled damper.

DESCRIPTION OF PREFERRED EMBODIMENTS

Figure 1:
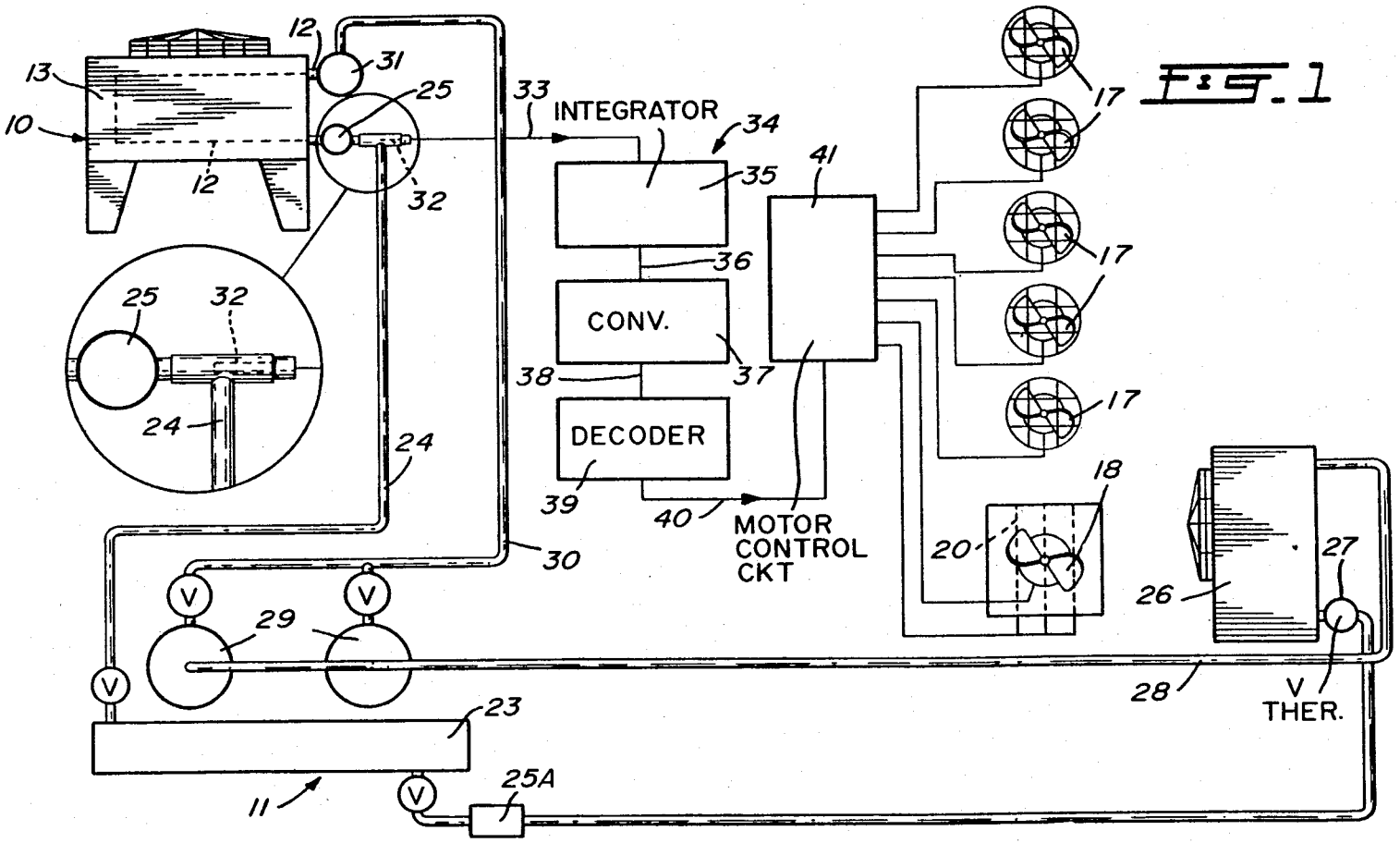
FIG. 1 is a schematic diagram showing the outdoor air cooled condenser of the present invention utilized in a single circuit refrigeration system.

Referring now to the drawings and more particularly to FIG. 1, there is shown the outdoor air cooled condenser assembly 10 of the present invention utilized in a refrigeration system 11 having at least one condenser coil 12 disposed in the housing 13 of the condenser 10. Although not shown the coils are disposed in a suitable manner within the housing 13 through a plurality of heat sink plates (not shown) constituting a heat transfer surface area for cooling the refrigerant gas passing through the condenser coils 12 in a typical manner.

As shown in FIGS. 2 and 3, the housing 13 has an open bottom end which constitutes an air inlet 14 and is provided with a plurality of openings on the top surface thereof to constitute a primary air outlet 15 and a plurality of secondary air outlets 16. A fan 17 is provided adjacent each of the secondary outlets 16 and each driven by a respective motor 8 to cause air convection from the inlet 14 to its respective secondary outlets 16. A further fan 18 driven by motor 19 is provided adjacent the primary outlet 15. The primary outlet 15 is also provided with a controllable damper 20 which is controlled to vary the size of the outlet opening of the primary outlet 15 from a fully open position to a fully closed position. Each of the secondary outlets 16 is provided with gravity-operated free floating butterfly damper 21. These dampers are constituted by opposed plates hinged at their lower ends 22 and as soon as the fan 17 is operated they pivot upwardly to open its associated secondary outlet 16. When the fan is stopped the damper plates fall back to their closed position closing off the secondary outlet. Thus, it can be seen that when the primary damper is closed and the secondary fan 17 are idle, all of the outlets are substantially closed and there is no substantial ambient air convection across the heat transfer surface 12' in the condenser.

As shown in FIG. 1 the refrigeration circuit comprises basically a receiver 23 which receives condensate from its associated return condensate line 24 connected to an outlet 25 of its condenser coil. The output of the receivers is conventionally connected through a dryer 25A to the inlet of an evaporator 26. A thermostatic expansion valve 27 is provided in the inlet of the evaporator 26. The suction line outlet 28 of the evaporator feeds the compressors 29 having their discharge line 30 connected to the inlet 31 of the condenser coil 12. Of course, in a multi-circuit refrigerant system or a multiple system installation there are other discharge lines feeding in other condenser coil in the housing 13.

Each of the outlets 25 of the condenser coils 12 is provided with a sensor 32, herein a temperature sensor to sense the temperature (proportional to its pressure) of the refrigerant gas at the condenser outlet 25. The sensor produces an error signal which is fed via its wire connection 33 to the input of a control circuit 34 which consists of an integrator circuit 35 having its input 36 connected to a converter 37. The output 38 of the converter is connected to a decoder 39 having its output 40 connected to a motor-controlled circuit 41. The integrator circuit 35 analyzes the input data received from a plurality of sensors 32 associated with the respective condenser coils 12 and produces an error signal at its output 36 which is dependent on the values of the input data. The converter circuit 37 converts the error signal in a form for use by the decoder circuit 39. The decoder feeds a control signal through its output 40 to the motor control circuit 41 which controls the operation of the secondary fans 17 or the primary damper means 20. The integrator circuit is programmed with a predetermined ideal condition set point value for the refrigeration system 11 and controls the secondary fans and the damper of the primary fan dependent on the value of the input data fed at its input whereby to control the amount of air passing through the heat transfer surface. The input data to the control circuit 34 is representative of the heat rejection load of the coils 12 and the entering air temperature in the housing. The data is compared with the ideal set point value of the refrigerant gas for the refrigeration system and each time the temperature in the gas exceeds a positive or negative tolerance level from the set point value the secondary fans are activated or de-activated and the damper of the primary fan is adjusted automatically whereby the refrigerant gas is brought substantially to the operating set point value temperature for ideal operating pressure of the refrigerant gas.

As shown in FIG. 3 the control damper 20 is constituted by a plurality of angularly controlled baffles or dampers 20' which are angularly controlled to regulate the size of the open area of the primary output 15 from a fully closed position to a fully open position. Additional baffle dampers 42 may be provided in the air convection paths, intermediate the housing 14 and the heat transfer surface 12', to obstruct the air convection path.

The operation of the system will now be described. At design entering air temperatures and at design heat rejection loads the multiple sensors 32 send data to the integrator 35 which analyzes the data, integrates it and, if the temperature is higher than the higher tolerance limits of predetermined preset value a signal is transmitted to the motor control circuit 41 for all fans to operate. Any changes in heat rejection load or entering air temperature are immediately identified by the sensors 32 which transmit continuous data to the integrator 35. If the integrated signal remains higher than the tolerance limit of the preset value, all fans continue to operate. Should a sensor or sensors detect a decrease in temperature (pressure) below the set point value, the integrator 35 transmits a signal to the motor control circuit 41 to adjust the position of the dampers of the primary fan to attempt to maintain the temperature within the tolerance range of the set point value, thus closing the dampers. The tolerance range may be, for example, 1.5° above and below the set point value.

Should the temperature of the refrigerant continue to fall below the lower tolerance limit of the set point value, and exceed it by one degree, then one of the secondary fans is automatically shut off. This causes a rise in the refrigerant temperature and if the temperature rises above the lower tolerance limit of the set point value, the dampers 20' start opening. If the temperature of the refrigerant then rises to a temperature within the tolerance limits of the preset value, then the remaining secondary fans continue to operate and the dampers are modulated to maintain the temperature of the refrigerant at substantially the set point value. Should there be a further drop in the temperature of the refrigerant below the lower tolerance limit of the set point value, then another secondary fan is shut off and the dampers 20' again control the cooling to maintain the ideal set point value for the refrigerant temperature. Should the refrigerant temperature then rise above the upper tolerance limit of the set point value, at that point the dampers 20' are fully open and a secondary fan is switched on when the temperature is at one degree above the upper tolerance level. The temperature of the refrigerant then drops causing the dampers 20' to close and the above described cycle is repeated.

A brief mathematical explanation follows. When the control dampers 20' are fully closed, the volume of air flow through the heat transfer surface is $$((N-1)\times(CFM/N)+(0.05(CFM/N))$$

where

CFM = total design air volume, and

N = number of sections.

If the integrated signal continues to remain below the preset value or if it rises and then again falls below the preset value, the integrated signal to the motor control circuit will cause one of the remaining fans to become idle and its convection control damper to close. Thus, a change takes place from: $(N-1)\times(CFM/N)+(0.05(CFM/N))$ to $(N-2)\times(CFM/N)+(2\times0.05(CFM/N))$.

Without a comparable immediate change in load or entering air temperature, an immediate rise in condensing temperature is sensed. The sensors immediately transmit this change to the integrator 35. The integrated signal to the motor control circuit 41 causes the control dampers on the primary control section to be reopened.

The control sequence outlined in the foregoing paragraphs is repeated until all secondary sections with singular air moving means are idle and their convection control dampers closed. The air volume now flowing through the heat transfer surface 12' is:

$$X(CFM/N)+(N-1\times(0.05(CFM/N))$$

If, at this point, we assume that the total heat rejection is unchanged from design conditions and that only a reduction in entering air temperature has occurred, the effective temperature difference at which the condenser is operating can be expressed as:

$$TD_2 = \frac{CFM}{X\,(CFM/N) + (N-1)\times(.05\,(CFM/N))} \times TD_1$$

where $TD_1$ = design temperature difference, $TD_2$ = effective temperature difference, N = number of sections, and CFM = design air volume.

If

N = 6,

CFM = 48,000, $TD_1$ = 15° F.

then $TD_2$ = 72° F. Assuming that the preset control value is equivalent to 90° F. condensing temperature, then the air entering the heat transfer surface is $$90-72=+18°\text{ F.}$$

The design objective is to control the condensing temperature at a minimum of 90° F. with a 50% reduction in heat rejection and entering air temperature of −40° F.

Using the example above, the primary control damper must now offset the remaining 58° F. temperature decrease, and a 50% reduction in heat rejection.

The sensors 32 continue to transmit data to the integrator 35 to control the air volume through the primary section from 100% to, theoretically, zero %. However, some minimal leakage will occur with even the best of damper means.

Other means of primary section volume control may be used such as multiple fans for example by equipping the primary section with six fans, with gravity convection damper and with the fans having graduated air volume capacities: three at 2,000 CFM, two at 1000 CFM and one at 500 CFM, sixteen increments of control would be available with the final increment being 500 CFM. The final result would be identical to the aforementioned primary damper control.

$$500+(5(0.05\times8000))=2500$$

$$(500+(5\times400)=2500\text{ CFM}$$

and the "Apparent" temperature difference is $$48000/2500\times15=288°\text{ F.}$$

If the heat rejection load has also reduced by 50%, then the "effective" temperature difference is $$48000/2500\times(15/2)=144°\text{ F.}$$

and air temperature entering the heat transfer surface is $$90°\text{ F.}-144=-54°\text{ F.}$$

It is within the ambit of the present invention to cover any obvious modifications of the example of the preferred embodiment illustrated herein, provided such modifications fall within the scope of the broad appended claims.

We claim:

1. An outdoor air cooled condenser for use in a refrigeration system having at least one refrigeration circuit, said condenser including a condenser coil assembly having a condenser coil and a heat transfer surface for said refrigeration circuit, a housing having air inlet and outlet means for the passage of air through said housing about said heat transfer surface, said outlet means having a primary outlet and a plurality of secondary outlets, air displacement means associated with a respective one of said primary and secondary outlets, damper means associated with each said secondary outlet, controllable damping means associated with said primary outlet to control the size of the opening thereof, sensing means connected to said condenser coil to sense predetermined condition of a refrigerant in said condenser coil, control circuit means for monitoring said sensed refrigerant condition with respect to a predetermined ideal condition set point value for said refrigeration system and for controlling said controllable damping means of said primary outlet and said air displacement means of said secondary outlets to control the amount of air passing through said housing and said condenser coil heat transfer surface in response to changes in said refrigerant condition resulting from heat rejection load changes in said coil or entering air temperature changes in said housing, whereby to substantially maintain said refrigeration system operating at said ideal condition set point value.

2. A condenser as claimed in claim 1 wherein there is provided a plurality of said refrigeration circuits operating at different temperature levels and each connected to one of a plurality of condenser coils in said housing.

3. A condenser as claimed in claim 2 wherein said sensing means is a plurality of sensors each of which is connected to the output of one of said condenser coils to sense the temperature of refrigerant in each of said coils.

4. A condenser as claimed in claim 3 wherein said sensors are connected in said control circuit means which also comprises an integrator circuit for analyzing the input data of said sensed refrigerant condition received from each said sensor in comparison with said predetermined set point value and for producing an error signal dependent on the relative deviations in values of said input data, and converter and decoder circuit means for converting and translating said error signal into usable form, and motor control circuit means for controlling said air displacement means in response to variations in said converted signal.

5. A condenser as claimed in claim 1 wherein said air displacement means are motor-operated fans associated with respective ones of said primary and secondary outlets.

6. A condenser as claimed in claim 4 wherein said controllable damping means are pivotal baffles secured in said primary outlet said baffles being angularly controlled to regulate the size of the open area of said primary outlet from a fully closed to a fully open position by said motor control circuit.

7. A condenser as claimed in claim 4 wherein said secondary outlets are each provided with a free floating butterfly damper to close off said secondary outlets when said air displacement means are inoperative.

8. A condenser as claimed in claim 1 wherein said controllable damping means are angularly variable baffles for said primary outlet to regulate the amount of air displaced through said primary outlet.

9. A condenser as claimed in claim 4 wherein said sensors provide input data to said control circuit means representative of said heat rejection load of said coils or entering air temperature in said housing and comparing same with said set point value, said set point value having a positive and negative tolerance level, said control circuit means activating selected ones of said air displacement means of said secondary outlet means when said input data is above said positive tolerance level and deactivating selected ones of said air displacement means of said secondary outlet means when said input data is below said negative tolerance level.

10. A condenser as claimed in claim 9 wherein said controllable damping means of said primary outlet is controlled to vary the amount of air displacement through said primary outlet to compensate for data signal variations within said positive and negative tolerance levels.

11. A condenser as claimed in claim 10 wherein said controllable damping means are pivotal baffles secured in said primary outlets, said baffles being angularly controlled to regulate the open area of said primary outlet from a fully closed to a fully open position.

12. A condenser as claimed in claim 10 wherein said controllable damping means are angularly movable baffles for said primary outlet to regulate the said CFM of air displacement through said primary outlet.

13. A method of controlling condensing temperature in an outdoor air cooled condenser having at least one refrigeration circuit connected to a condenser coil assembly having a heat transfer surface and being secured in a condenser housing having air inlet and outlet means with damper means and air displacement means for the convection of air from said inlet to said outlet means about said heat transfer surface, said method comprising the steps of:

(i) sensing a predetermined refrigerant condition in said condenser coil and providing an error signal representative of said condition, (ii) analyzing said error signal with respect to a predetermined ideal condition set point value of the refrigerant condition for said refrigeration system and producing a control signal, (iii) controlling said air displacement means when said error signal exceeds positive or negative tolerance levels from said set point value, and (iv) controlling said damper means when said error signal is within said tolerance levels but above or below said set point value whereby to substantially maintain said refrigeration system operating at said set point value.

14. A method as claimed in claim 13 wherein said step (ii) of analyzing said error signal comprises:

(a) providing an output signal representative of a control signal derived from said error signal deviation relative to said set point value, (b) converting said output signal to feed a decoder circuit, and (c) decoding said converted signal to provide control signals to a motor control circuit to control said air displacement means and damper means.

* * * * *